US009555529B2

(12) United States Patent
Ronconi

(10) Patent No.: US 9,555,529 B2
(45) Date of Patent: Jan. 31, 2017

(54) DEVICE FOR APPLYING FASTENING MEANS

(71) Applicant: FASCO S.R.L., Cadriano di Granarolo dell' Emilia (IT)

(72) Inventor: Marco Ronconi, Bologna (IT)

(73) Assignee: FASCO S.R.L. (IT)

( * ) Notice: Subject to any disclaimer, the term of this patent is extended or adjusted under 35 U.S.C. 154(b) by 514 days.

(21) Appl. No.: 14/083,149

(22) Filed: Nov. 18, 2013

(65) Prior Publication Data

US 2014/0138422 A1 May 22, 2014

(30) Foreign Application Priority Data

Nov. 16, 2012 (IT) ..... BO2012A0627

(51) Int. Cl.
*B25C 1/00* (2006.01)
*B25C 5/16* (2006.01)
*E04F 21/22* (2006.01)

(52) U.S. Cl.
CPC ..... *B25C 1/001* (2013.01); *B25C 5/1693* (2013.01); *E04F 21/22* (2013.01)

(58) Field of Classification Search
CPC ..... B25C 5/1617; B25C 7/00; B25C 5/1693; B25C 1/00–13/00; E04D 2015/045
See application file for complete search history.

(56) References Cited

U.S. PATENT DOCUMENTS 3,854,648 A * 12/1974 Inzoli ..... B25C 1/003 227/130
4,033,499 A * 7/1977 Butler ..... B25C 5/1693 227/120
4,424,929 A * 1/1984 Weis ..... B25B 31/00 227/113
5,810,239 A * 9/1998 Stich ..... B25C 7/00 227/119
5,947,362 A * 9/1999 Omli ..... B25C 5/1693 227/120
6,089,437 A * 7/2000 Blacket ..... B21J 15/32 227/136

(Continued)

OTHER PUBLICATIONS

Italian Search Report for corresponding Italian application No. IT BO20120627, 2 pages, completed Oct. 30, 2013.

*Primary Examiner* — Andrew M Tecco
(74) *Attorney, Agent, or Firm* — Ware, Fressola, Maguire & Barber LLP

(57) ABSTRACT

A device for applying fasteners having one almost flat head having a central pass through hole, two opposed sides having protrusions approximately perpendicular to the head forming shoulders, has a first nail magazine for locking a fastener. A shooting device shoots a nail through the fastener central hole. A second magazine has a slide guide housing a set of fasteners, with tongues oriented in a forward sliding direction, the shoulders oriented towards an outlet. The outlet has jaws hinged to rotation pins, perpendicular to the sliding direction. Front portions of the jaws fully protrude from the second magazine, each jaw having teeth having a shoulder shape to match a shoulder shape of a fastener interposed between the jaws. The teeth elastically and detachably hold the fasteners in an aligned position with the pass through hole and with the shooting direction of the shooting device.

20 Claims, 8 Drawing Sheets

(56) References Cited

U.S. PATENT DOCUMENTS

| | | | | |
|---|---|---|---|---|
| 6,302,310 | B1 * | 10/2001 | Lamb | B25C 1/006 221/232 |
| 6,478,209 | B1 * | 11/2002 | Bruins | B25C 5/1693 227/136 |
| 7,090,455 | B2 * | 8/2006 | Lamb | B25C 1/006 206/338 |
| 2001/0054635 | A1 * | 12/2001 | Schmitz | B25C 5/1693 227/15 |
| 2005/0189394 | A1 * | 9/2005 | Terrell | B25C 5/1665 227/130 |
| 2009/0057366 | A1 * | 3/2009 | Braddock | B25C 1/005 227/120 |

* cited by examiner

FIG.6
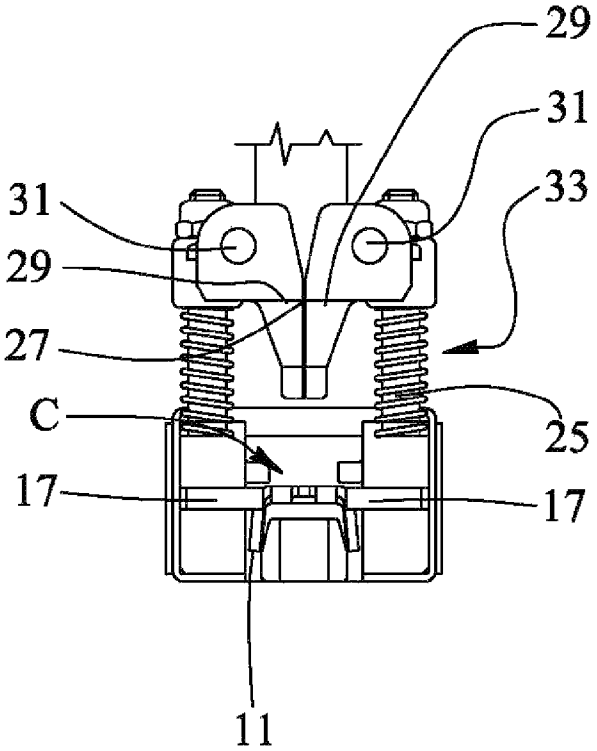
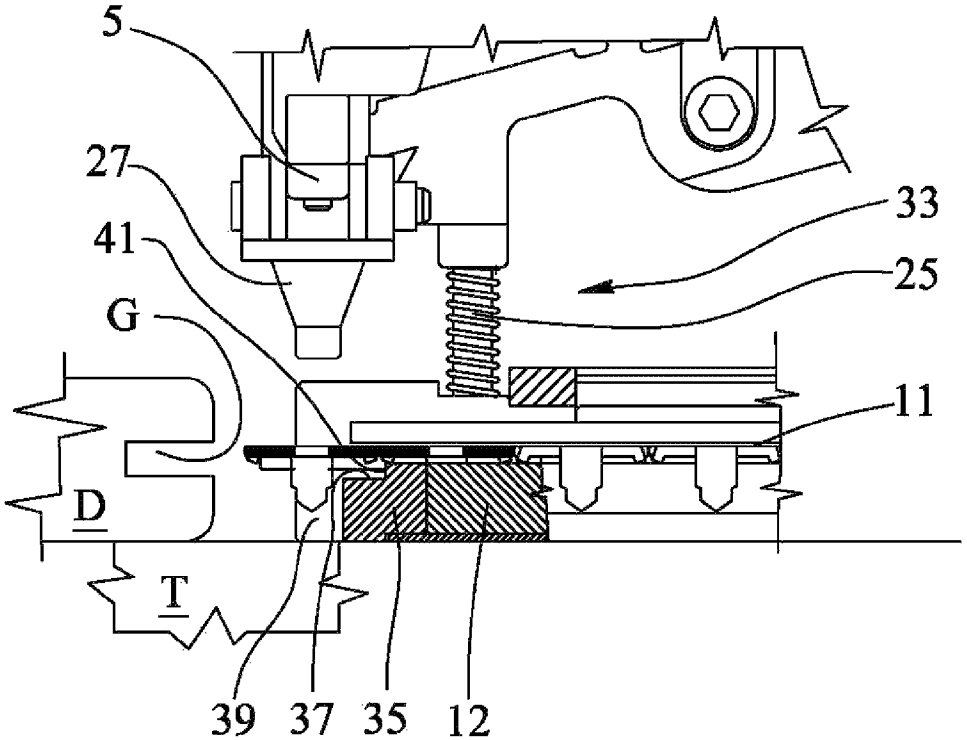
FIG.5

FIG.9
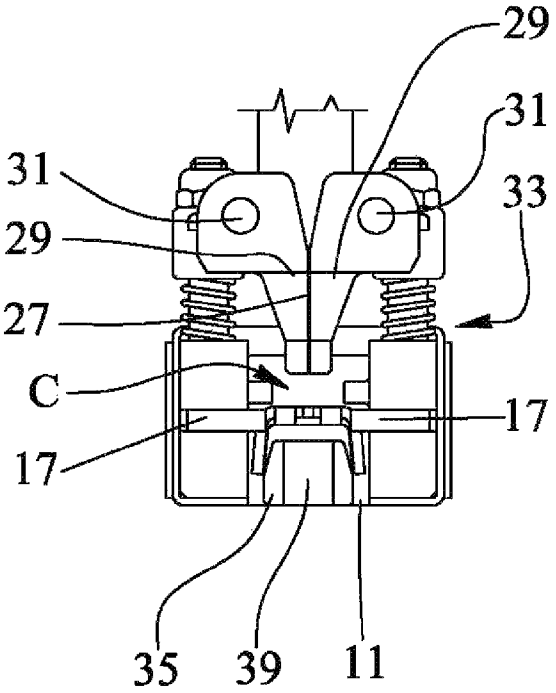
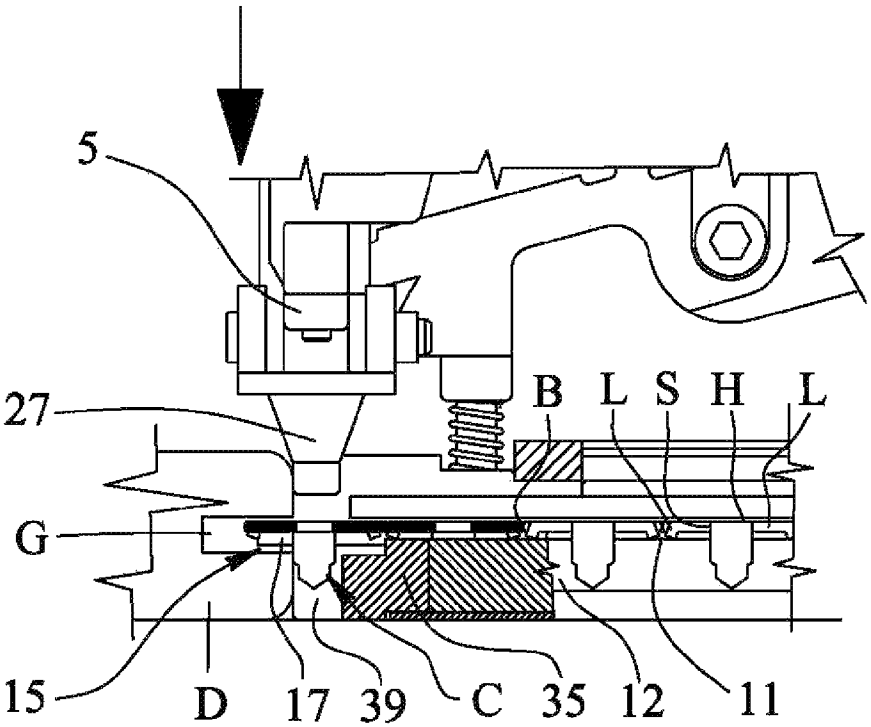
FIG.8

FIG.11
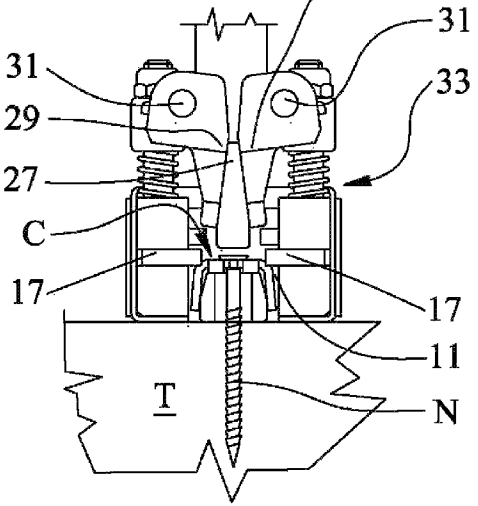
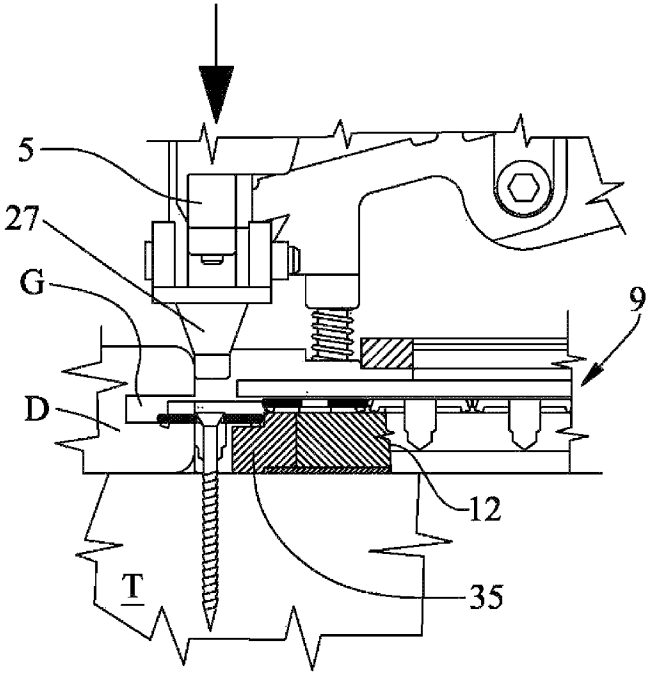
FIG.10

DEVICE FOR APPLYING FASTENING MEANS

TECHNICAL FIELD

The present invention relates to the field concerning tools for applying and fastening of clips, and in particular relates to a device for applying fastening means consisting of clips for mounting floors, parquet of mutually spaced slats.

BACKGROUND

There are known fastening means consisting of metal clips with a sort of plate head, roughly flat and approximately rectangular shaped in plan. Two opposite sides of the head have respective thin and elongated protrusions, bent perpendicularly, or nearly so, to the plane of the head and facing forming a pair of parallel legs. The remaining two opposite sides of the head form respective tongues with distal edges approximately straight or concave or convex; each of these tongues can be coplanar with the central portion of the head or slightly inclined and its edge can be provided with optional small nails, protruding in the same direction of the legs.

The central portion of the head has a circular shaped through-hole.

The clips are assigned to fix to a structure, constituted for example by joists or rafters of wood or of other material suitable to be nailed, a set of parallel boards or slats made of wood, of a wood derivative or substitute or any substitute materials. Each of the minor lateral longitudinal faces, namely the longitudinal edges, of the slats is provided with a respective longitudinal groove, whose cross section has dimensions complementary to, or bigger than, those of the tongues of the fasteners to house these tongues.

Operationally, a tongue of a clip must be inserted in a longitudinal slot of a slat for example, already partially placed in the work. Such a clip, with a tongue inserted into the groove, is placed above one of the rafters or other element of the support structure. The legs of the clip directed to or in contact with such a rafter to which the clip is fixed by means of a nail inserted into the central hole of the head of the same clip and fixed into the rafter until the head of the nail and the head of the clip are in mutual abutment and until the distal ends of the legs of the clip are in contact with the rafter.

When the fastening of the slat is done, each cross between the groove and the rafters of the support structure has a nailed clip. The free tongues of such clips are aligned and ready to be inserted into a groove of a further slat to be assembled and which will be in turn completely locked by the application of other clips in its remaining groove. At the end of the operations, the slats are fixed parallel to the support structure and mutually spaced apart by a distance which approximately corresponds to the longitudinal dimension of the central portion of the fastener's head.

The clips can be joined together to carry out rows of clips by means of thin and short breakable union joints of the distal ends of the tongues of the adjacent slat clips.

U.S. Patent Publication no. US2001/054635 A1 discloses a device having a fastening magazine, a nail magazine and nail shooting means to shoot a nail from the respective magazine through a hole of a round fastening, from a respective magazine, fixing it onto a support.

The device comprises a seat means provided with a couple of resilient longitudinally scored arms assigned to hold a round fastening before and during nailing and to release the nailed fastening through an opening of the seat after nailing. One of the two arms and the round fastening are almost completely housed inside the seat means whose size, shape and lower side opening position render it not fit for inserting the edge of the fastening inside slots or a narrow cavity. Furthermore the scored arms are fit only to avoid the unwanted falling down of the fastening through the opening.

SUMMARY OF THE INVENTION

One object of the present invention is to propose a device for applying fastening means consisting of the above described clips arranged in splints or also individual clips.

Another object is to propose a device for applying fastening means consisting of a plurality of said clips, free from mutual constraints.

A further object is to propose a device which facilitates positioning and insertion of the tongues of the clips into the grooves.

Another purpose is to propose a device which provides a safe and easy locking by nails of clips to the support structure.

BRIEF DESCRIPTION OF THE DRAWINGS

The characteristics of the invention are highlighted in the following with particular reference to the accompanying drawings, in which:

FIGS. 5 and 6 show respectively side and front partial views of the device of FIG. 1 in an approaching condition to a slat to be fixed;

FIGS. 8 and 9 show respectively side and front partial views of the device of FIG. 1 in a condition of inserting a fastening item into the slot and of setting up for a nail shooting for locking the fastener;

FIGS. 10 and 11 show respectively side and front partial views of the device of FIG. 1 in a condition immediately subsequent to the shooting of the nail, locking the fastening means;

DETAILED DESCRIPTION OF THE INVENTION

Figure 1:
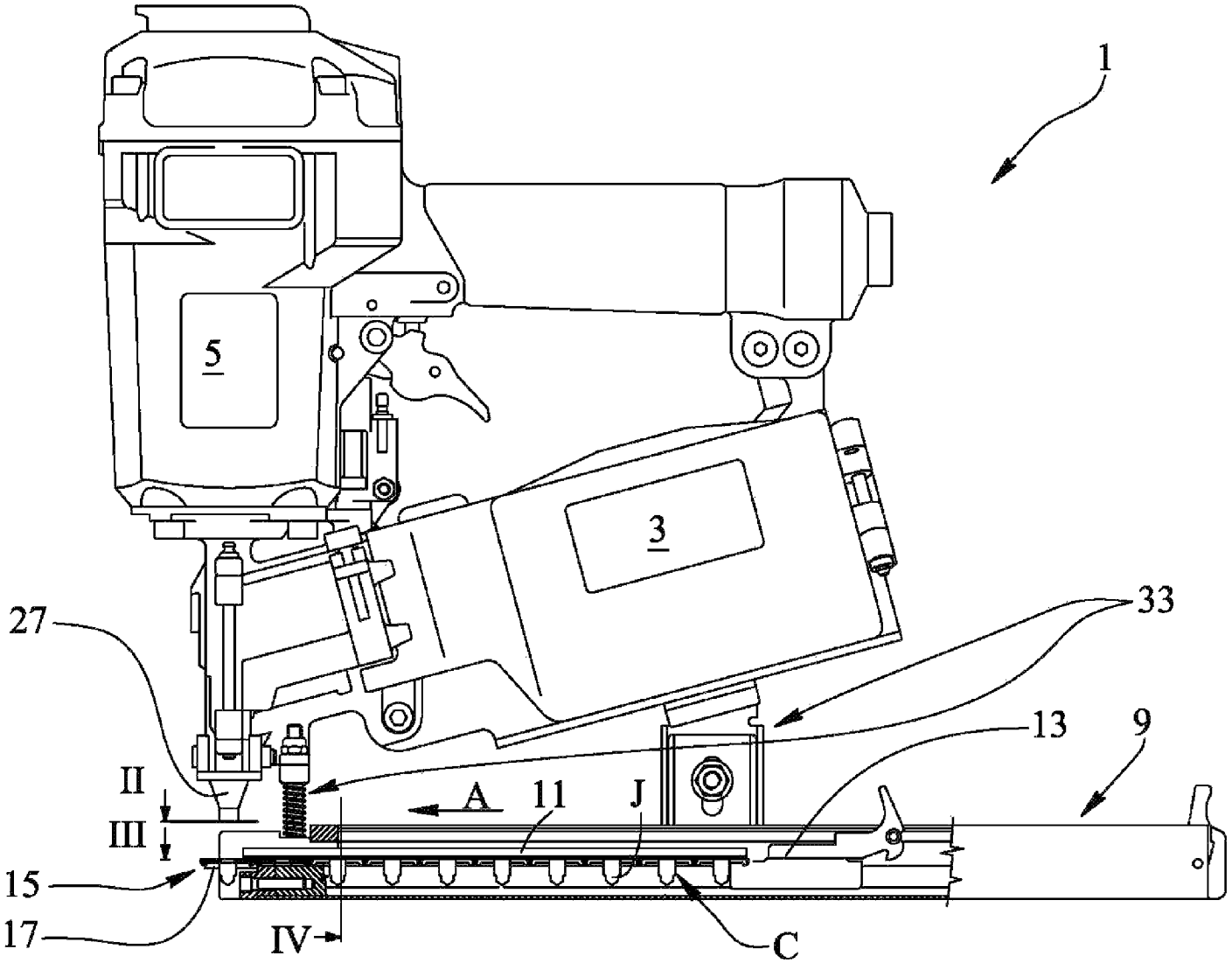
FIG. 1 shows a side view of the device for applying fastening means of the present invention in which some parts have been removed to better illustrate others.
Figure 2:
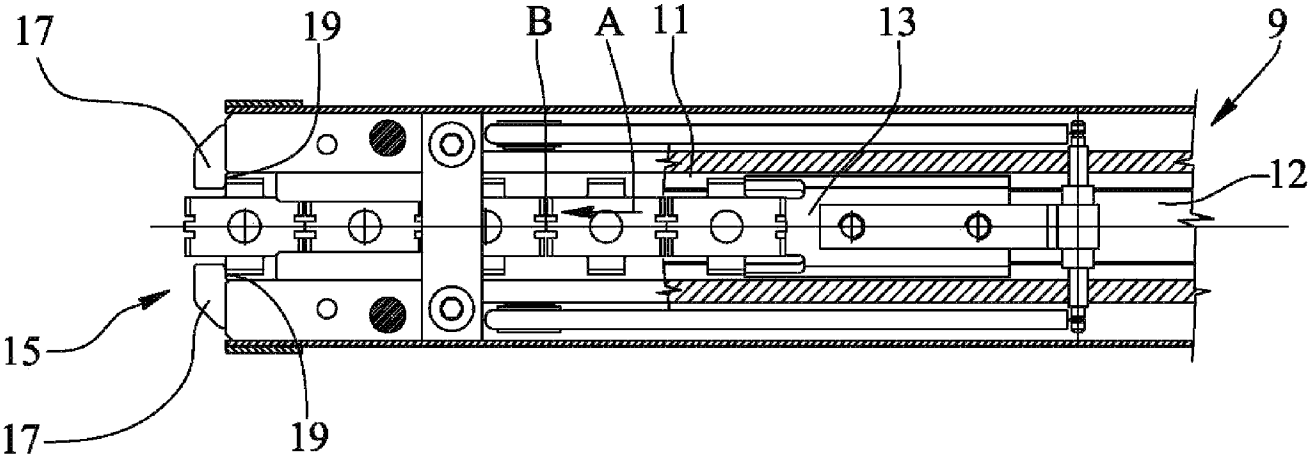
FIGS. 2, 3 and 4 show sectional views respectively taken along lines II-II, III-III and IV-IV of FIG. 1.
Figure 4:
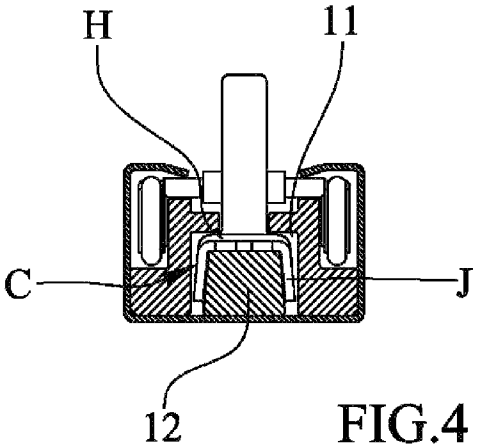
Figure 3:
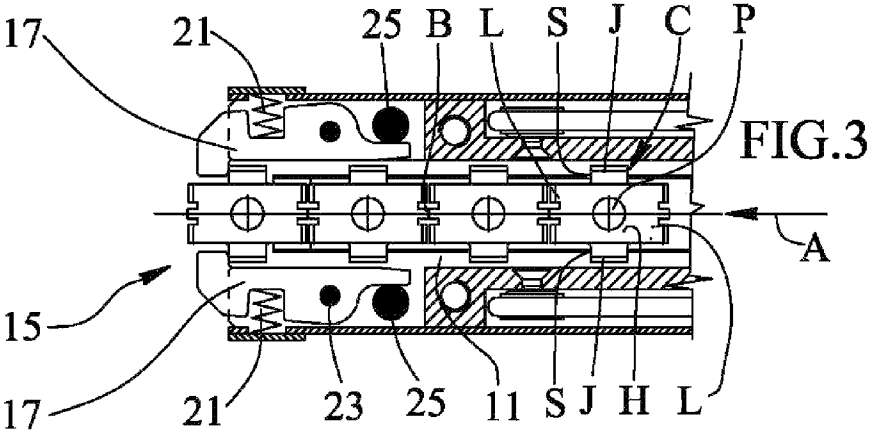
Figure 15:
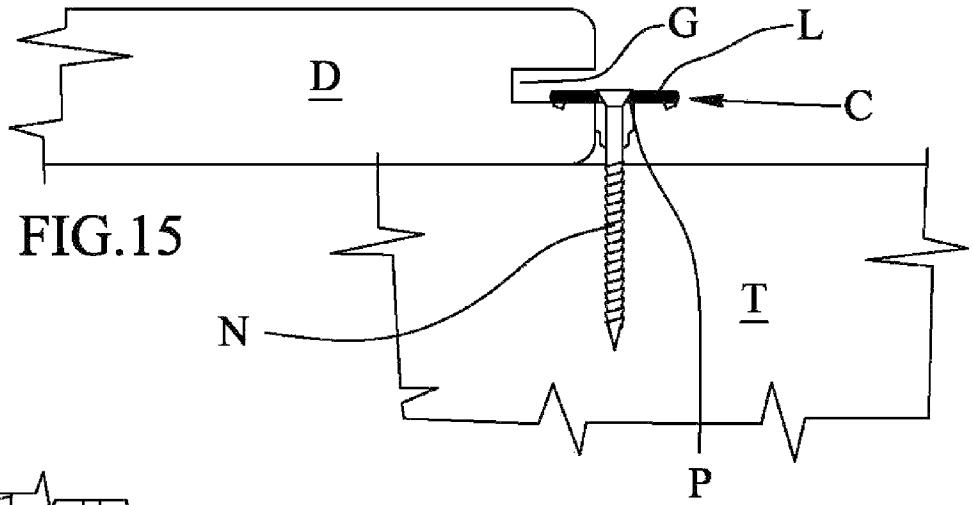
FIG. 15 shows an enlarged and sectional view of the fastening means nailed to the support structure and engaged in the groove of the slat in the same conditions of FIG. 14.
Figure 7:
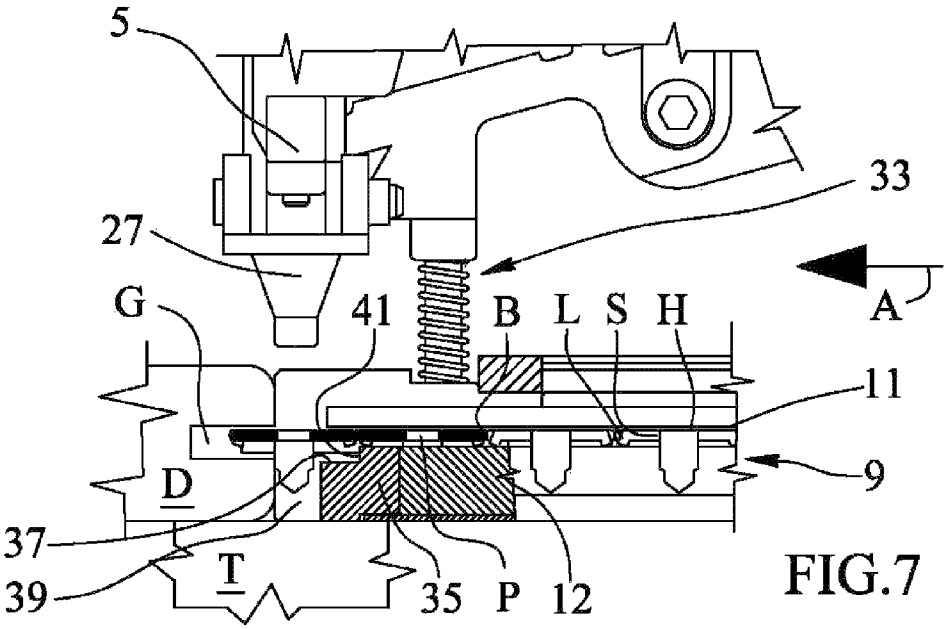
FIG. 7 shows a partial and side view of the device of FIG. 1 in an inserting condition of a fastening means into the slot of the slat to be fixed.

With reference to FIGS. 1 to 15, numeral 1 indicates the device which is the object of the present invention, for applying a fastener C of both known type and unknown type.

The fasteners C are designed to mutually distance and to fix the boards, planks or slats D made of wood, derivatives or substitutes of wood, to a support structure consisting, for example, of parallel joists or rafters T made of wood or other nailable material.

The minor lateral longitudinal faces, namely the longitudinal edges, of the slats D are provided with respective longitudinal grooves G whose cross section has dimensions complementary to, or greater than, those of the sections of the tongues of the fastening means C in order to accommodate these tongues.

Each fastener C is equipped with a central portion or centrally roughly flat head H provided with a through hole P.

Two opposite sides of said head H have respective protrusions J at least approximately perpendicular to the head H and forming side shoulders S. These protrusions J constitute a pair of legs of the fastening means C.

The remaining two opposite sides of the head H of the fastener C have respective tongues L protruding from the head H itself. These tongues L can be coplanar with the head or slightly inclined with respect to it and can be provided at their ends with teeth or nails.

The fasteners C can be separated or preferably are united in arrays or rows of fasteners by using frangible bridges B connecting the tongues of adjacent fasteners C.

The device 1 comprises a first magazine or store 3 for the nails N assigned to fix the fasteners C, the device also including a shooting device 5 assigned to shoot such nails N in a shooting direction.

The nails N have a stem and a respective head. The cross section of the stem is equal to or less then the diameter of the hole H of the fastener C and the cross section of the nail head is greater than said hole H.

The shooting device and the first store can be, for example, those of a pneumatic nail gun.

The device 1 comprises a second magazine or store 9 provided with a sliding guide 11, preferably straight, to slidably accommodate a set of fasteners C, preferably joined to form a row.

The second store 9 is provided with a thrust spring 13 assigned to elastically thrust and slide the fasteners C in a forward sliding direction A, along the second store 9 toward the outlet end 15 of said second store for the fasteners.

The two tongues L of each fastener C housed into the second store 9 protrudes from the head one toward the outlet end 15 and the other in the opposite direction. In other words, the tongues are oriented toward opposite directions and the longitudinal axis thereof lie on the sliding direction A. The shoulders S of each fastener C housed into the second store 9 are transversely oriented in respect to the forward sliding direction A and face the outlet end 15.

For reference orientation, in an operating condition of the device for the mounting of fasteners C on a horizontal structure, the second store 9 is horizontal and is located below the first store 3 for nails N and below the shooting device 5. Nevertheless, the device can operate in any orientation.

In the following, reference will be made to the orientation above mentioned.

The sliding guide 11 comprises an elongated longitudinal median rib 12 whose transversal section is rectangular or frustoconical shaped. The rib 12 is longitudinally fixed into the second store 9, parallel to the sliding direction A and is spaced from the top and side inner walls of the latter 9 to form the horizontal longitudinal cavity with cross section approximately "C" shaped with the two ends thereof facing down, to slidably accommodate the set or rows of fasteners C with the respective heads H oriented almost horizontally and placed above the legs of the protrusions.

The inner faces of the fasteners C match in a sliding manner with the longitudinal side and top faces of the rib 12.

The thrust spring 13 pushes and translates the fasteners C along the sliding direction A, by reason of the consumption of the fasteners C themselves, towards an outlet end 15 of the second store 9.

This outlet end bears a pair of jaws 17, driven by respective elastic elements 21, and assigned to elastically abut with a fastener C for elastically and reversibly locking it in an alignment position of the respective through hole P to the shooting direction of the shooting device 5.

The jaws 17, for example consist of flat plates horizontal oriented and almost coplanar or parallel to the geometric plane of the head H of the interposed fastener C.

The plates of the jaws 17 have a shaped plan profile and are made of steel.

Referring to the forward sliding direction A along the second store 9, the front portions of the jaws 17 fully protrude from the second store 9. The jaws 17 are hinged to respective first pivot pins 23 perpendicular to said sliding direction A.

The first pivot pins 23 are also approximately perpendicular to the plane defined by the heads H of the fasteners C in the second store 9 or, being such that the horizontal plane in the orientation chosen for the description, the first pivot pins 23 are almost vertical.

The plan view of the mutually facing edges of the portions of the jaws 17 assigned to abut with a fastener C, are roughly "L" or "S" shaped. Each of said edges has at least one tooth 19 shaped as a shoulder oriented against the sliding direction A, or in other words towards the thrust spring 13.

The teeth 19 are assigned to elastically abut with the shoulder S of the fasteners C. When the jaws 17 are in the condition of the elastic reversible abutment with the fastener C, each of said teeth 19 matches with the respective shoulder S and is oriented perpendicular or nearly perpendicular in respect to the forward sliding direction A. The elastic elements 21 are, for example, of compressed helical type and each acts on the distal end of the respective jaw 17 in the direction of the other and opposed jaw 17. In this way, the elastic elements 21 provide jaws 17, the respective elastic forces of mutual approaching towards the head of the fastener C.

The front and abutting portion of each jaw 17 has a shape, thickness and length designed to allow and to facilitate the introduction of said portion, together with the interposed tongue L of the head H of the fastener C, into the longitudinal groove G and the near parts of the device are shaped, sized and positioned for avoiding interferences during said introduction.

Figure 13:
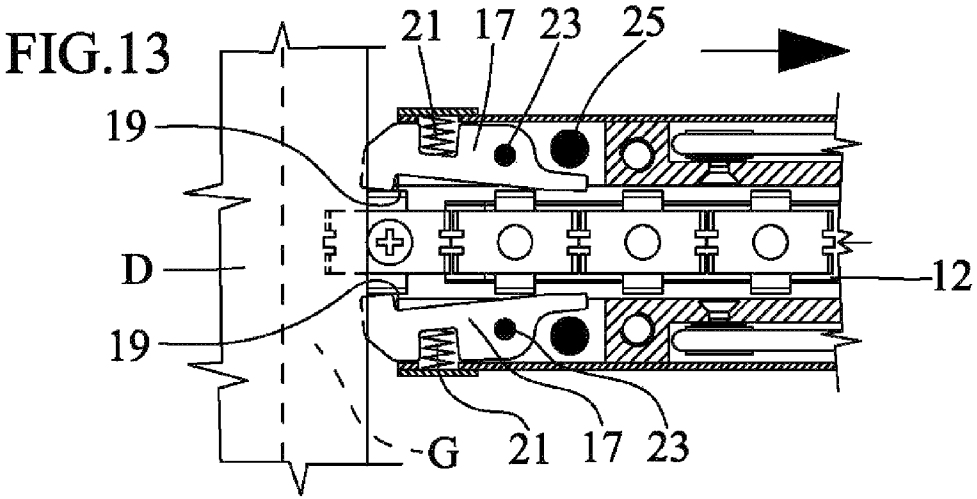
FIGS. 12-14 show partial and section views of the device of FIG. 1 according the same section plane of FIG. 3 respectively in the conditions immediately after the shooting, of partial and of complete detachment of the fastening means from the device.
Figure 14:
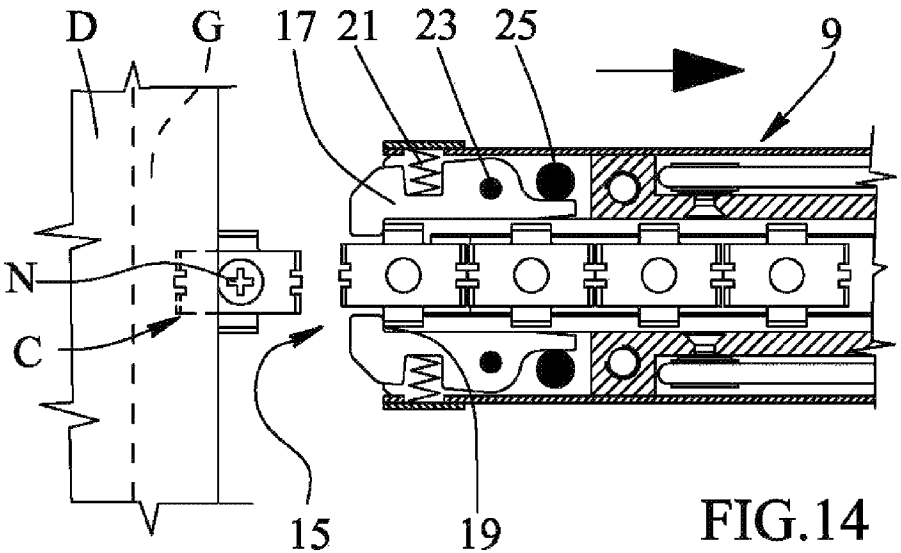
Figure 12:
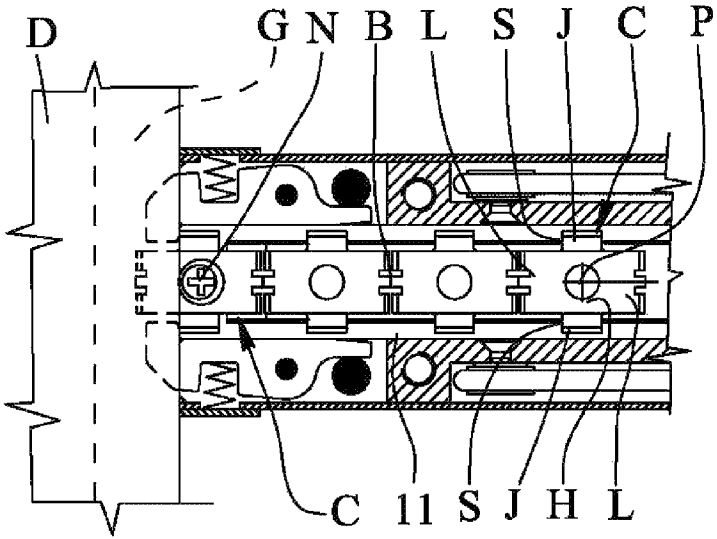

The resilient match of said teeth 19 with the shoulders S and/or with the protrusions J of the interposed fastener C keep the through hole P aligned to the shooting direction, thereby avoiding the resilient force generated by the thrust spring 13 causing the uncontrolled and unvented ejection of the fastener C out of the second store 9. In the same time, said resilient match allows the separation from the device of the fastener C engaged in the longitudinal grooves G of the slat D and fixed by the nail N to the rafter T as shown in FIG. 13.

It is important to underline that the device members and especially the jaws 17, allow and facilitate the release of the fastener C, after the nailing thereof, in the same or almost the same forward sliding direction A of the fastener C inside the second store 9 or, in other words, in an opposite direction of introduction of the jaws 17 and tongue L of the fastener C into the longitudinal groove G.

Possibly the jaws 17 can elastically match with the protrusions J instead of or together with the shoulders S and optionally they 17 can elastically match with the sides of the head of the fastener C.

The device 1 also comprises structures for rotating the end 25, for instance consisting of vertical pins or studs, for mating with the jaws 17 approximately in the condition of elastic reversible blocking preventing their further approaching.

The device further comprises a stop 35 positioned as an extension of the rib 12 and aligned and rigidly fixed to the latter 12.

The stop 35 is located below the jaws 17, in other words and in respect of the latter 17, the stop 35 is located in the side opposite to the shooting device 5.

The stop 35 is provided with an abutment face 37 sited below the head H of a fastener C kept between the jaws 17, the stop 35 being provided with a slot shaped median recess 39 having an end opened in the opposite direction of the rib 12 and positioned below a muzzle 27 of the shooting device 5.

The abutment face 37 is assigned to match with the lower face of the head H of the fastener C, stopping its stroke during the nailing thereof.

The abutment face 37 is locate at a distance from the contact geometric plane of the device with the rafters T, said distance is determined to stop the fastener C at the right distance from said rafter T.

In such manner, the deformation and damage of the fastener C or the too much lower positioning of the latter C in respect to the rafter T, caused by the trust of the shooting device 5, is prevented.

Preferably, the abutment face 37 is parallel to the head H of the fastener C kept by the jaws 17, in other words, the abutment face 37 is horizontal.

The recess 39 prevents the nail N from interfering with the abutment face 37 or other parts of the stop 35.

The stop 35 further comprises a transversal step 41 located below the bridges B joining the fasteners C kept by the jaws 17 with the adjacent fastener C and the step 41 being designed to facilitate, by a kind of shearing of their weak connection, the detachment of said two adjacent fasteners C during the nailing by braking the bridge.

The shooting device 5 is inferiorly equipped with a muzzle 27 having an internal cavity for the output of the nails N whose longitudinal axis is approximately perpendicular to the plane of the heads H of the fastener C of the second store 9 and passes for approximately the center of the hole H of the fastener C kept between the jaws 17.

The muzzle 27 is constituted by at least two movable members 29, for example consisting of two symmetrical shells of molded steel, each having a respective longitudinal portion of the internal cavity.

These movable members 29 oscillate between a passage predisposition condition of the stem of a nail N in which these members are adjacent in mutual contact and delimit the inner cavity and a passage condition of the nail head in which they are separated by opening the cross section of the inner cavity for the passage of the nail head. The muzzle 27 also includes an elastic member for transmitting to the movable members 29 elastic forces of mutual approach and contact.

In the adjacency condition of mutual contact of the two movable members 29, the diameter of the cross section of the external end portion, or distal portion, of the cavity of the muzzle 27 is equal to or slightly bigger than the diameter of the nail stem. In this manner, the muzzle 27 guides the nail stem along the longitudinal axis of the respective distal portion of the cavity by directing with precision through the hole H of the fastener C kept between the jaws 17.

The proximal end portion, or more internal with respect to the shooting device, of the cavity of the muzzle 27 is preferably frustoconical shaped with a vertex connected to the external end portion, thereby the shape of the distal portion of the cavity facilitates the entry as the shot nail head, causing the separation of the movable members 29, allowing the exit.

The two symmetrical movable members 29, are constrained to rotate about respective second pivot pins 31 mutually parallel and perpendicular to the longitudinal axis of the inner cavity of the muzzle 27 and are therefore horizontal.

The second store 9 is connected to the first store 3 for nails N and/or shooting device 5 via a connector 33 of a mobile and elastic type allowing a translation or almost translation for an elastic return type for the shooting device 5 towards the jaws 17.

In particular, the connector 33 comprises a pair of vertical prisoners for translation or almost translation of the second store compared to the shooting device and a hinge with a rotation axis perpendicular to the prisoners. The hinge is placed at a relatively large distance from the translation prisoners which preferably are made by an end rotator 25 or by their upward extension. The connector 33 also includes coil springs constrained to translation the prisoners and for acting in the removal of the second store from the shooting device 5. The vertical prisoners are associated with a security lock to prevent the shooting device 5 from ejecting the nails in conditions other than those in which the springs of the vertical translation prisoners are compressed as a result of a manual operator.

The operability of the device, starting from a condition in which it is fed from a source, the store is loaded and must be fixed in a groove of a slat or axle to an underlying structure of horizontal joists, expected to manually move the device up to a position in a protruding tongue of the fastener C held between the jaws 17 into the groove and the legs of the respective protrusion J in contact or on the vertical of the structure joist, to press down onto the handle and acting onto the trigger of the shooting device causing the expulsion of a nail passing through the hole into the joist up to the abutment of the nail head with the hole edge and the leg ends of the protrusions J with the structure joist.

Figure 16:
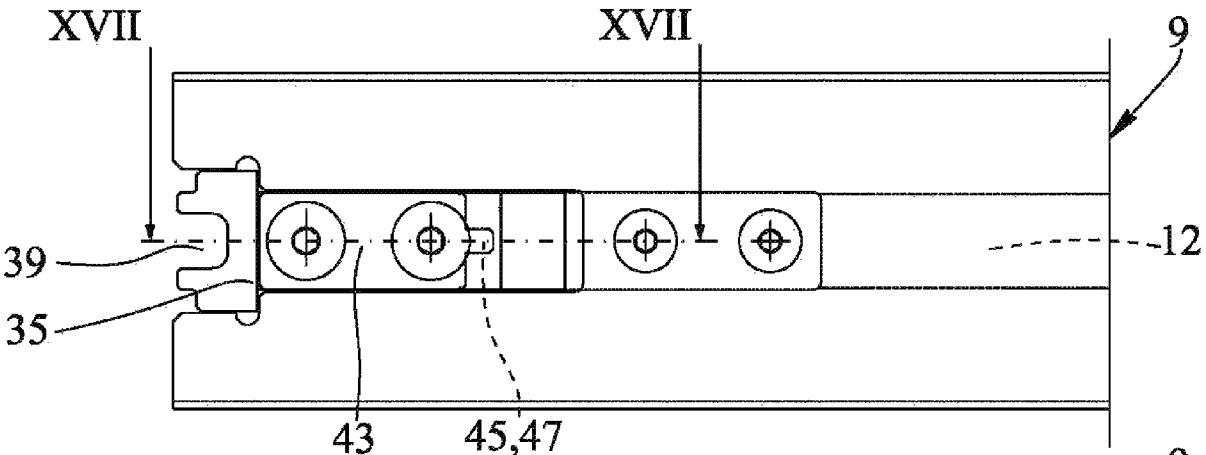
FIGS. 16-18 show partial and respectively bottom, sectioned by plane XVII-XVII and top views of a variant of the previous figures device.
Figure 17:
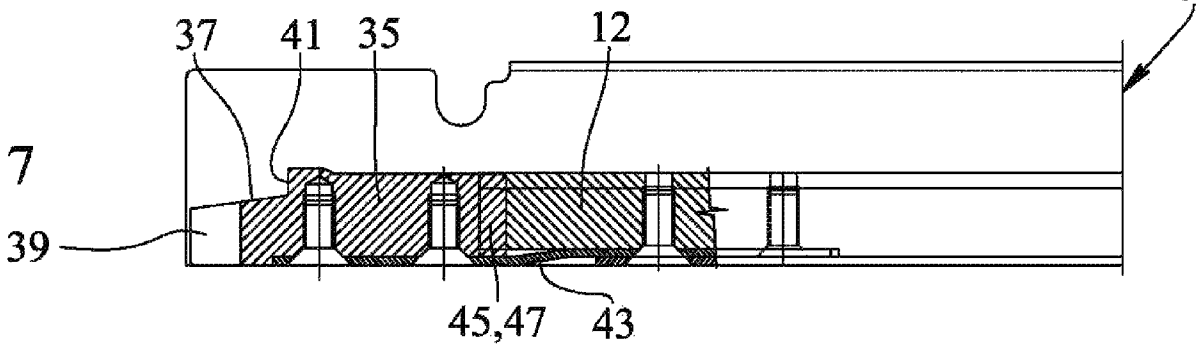
Figure 18:
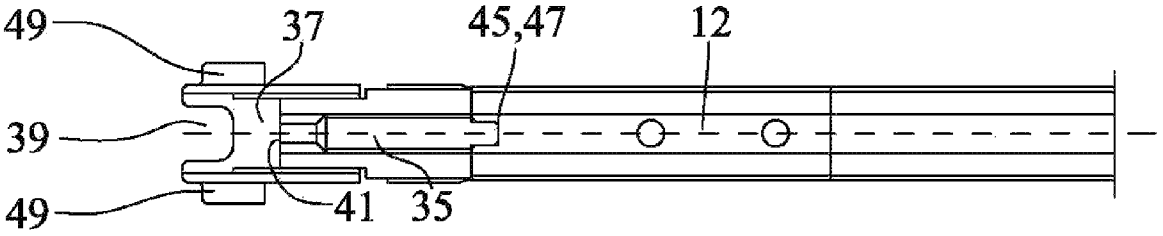

The variant of FIGS. 16-18 differs from the preceding embodiment in that the stop 35 is connected to the second store 9 or preferably to the rib 12 by a resilient element 43 that is elastically deformable in the shooting direction of the shooting device 5. The resilient element 43 carry out a resilient connection, which is movable in the vertical direction.

The resilient element 43 has an elongated plate shape and is made of harmonic steel or another resilient material and the resilient element 43 is preferably slightly "S" bended in its median portion.

The ends of the resilient element 43 are fixed to the lower portions, in other word the portions assigned to match with the rafter T, respectively of the stop 35 and of the rib 12 by pairs of screws or of other anti-rotation fixing elements.

The stop 35 and the rib 12 are provided, the one with a rib 45, the other one with a channel 47 mutually and engaged in a sliding manner. Both the rib 45, and the channel 47 are perpendicularly oriented in respect to the below resilient element 43.

The stop 35 is further provided with side wings 49 designed to cooperate with the resilient element 43, with the rib 45 and the channel 47 for centering the stop 35.

The abutment face 37 is inclined in respect to the geometric plane of mutual contact between the device and the rafters T so that the distal end of the abutment face 37 is lower in respect to the proximal end thereof 37.

An advantage of the present invention is to provide a device for applying fasteners consisting of clips arranged in splints or also individual clips.

Other advantage is to provide a device for applying fasteners consisting of a plurality of clips free from mutual constraints.

A further advantage is to provide a device facilitating the insertion and positioning of the tongues of the clips into the grooves.

Another advantage is to provide a device designed to provide a safe and easy locking for clasps by nails to the support structure.

The invention claimed is:

1. A device for applying fasteners, comprising:

a first magazine for nails, each nail assigned to block a central pass through hole in a respective fastener;

a shooting device for shooting the nails in a shooting direction through the central pass through hole in each respective fastener for fixing the respective fastener in a longitudinal groove of an edge of a board, plank, or slat by penetrating a joist, rafter, or other support structure abutting the board, plank, or slat;

a second magazine having a slide guide for housing in a sliding manner a set of fasteners, each fastener having at least one head, the central pass through hole, with two opposed sides of said head having respective protrusions forming shoulders, and two additional opposed sides of the head having respective tongues jutting out of the head with the tongues oriented in a forward sliding direction and the shoulders being oriented transversally and towards the sliding direction;

a thrust spring provided in the second magazine for biasing the fasteners of the second magazine, the thrust spring pushing and translating the fasteners along the forward sliding direction by reason of consumption of the fasteners themselves towards an outlet end of the second magazine;

said outlet end having a pair of jaws hinged to respective first rotation pins oriented perpendicularly with respect to said sliding direction, said jaws being mutually faced, and having front portions, in respect to the sliding direction, being elastically and mutually approached by respective elastic elements, said front portions fully protruding from the second magazine toward said sliding direction, each of said jaws having at least one tooth shaped in a form of a shoulder oriented towards the thrust spring in the second magazine and against the sliding direction, said tooth elastically matching at least with one shoulder of the head of a fastener interposed between the jaws;

said tooth elastically and detachably holding the fastener in an aligned position with respect to the pass through hole and with the shooting direction of the shooting device such that a front portion of each law has an edge thickness that allows introduction of said front portion, together with a tongue of the head of the fastener into the longitudinal groove of the edge of the board, plank, or slat without interference during fixing of the fastener.

2. The device according to claim 1 wherein the first rotation pins are approximately perpendicular with respect to the geometrical plane defined by the heads of the fasteners housed in the second magazine and the portions of the jaws matching said at least one shoulder with an "L" or "S" shape, each tooth matching with a shoulder, oriented approximately perpendicularly relative to the sliding direction when the fastener is in the elastic and detachable holding condition, the elastic elements transmitting to the jaws respective elastic forces for the mutual approach of said portions of the jaws designed to meet the fastener.

3. The device according to claim 2, further comprising a rotation arrestor designed to engage with the jaws when in the elastic and detachable holding condition.

4. The device according to claim 1, wherein the slide guide is provided with a longitudinal cavity whose transversal section is approximately "C" shaped for slidably housing a set of fasteners.

5. The device according to claim 1, wherein the shooting device has a muzzle having an inner longitudinal cavity for the ejection of nails, and having a longitudinal axis which is approximately perpendicular with respect to the geometrical plane of the heads of the fasteners in the second magazine, said axis passing through the hole of the fastener that is held by the jaws.

6. The device according to claim 5, wherein the muzzle has at least two mobile members, each mobile member forming a respective longitudinal portion of the inner cavity; said at least two mobile members being movable between a ready for the nail stem passage condition, in which said mobile members are adjacent and in mutual contact to fully define the inner cavity, and a nail head passage condition in which the mobile members are spaced apart for opening sections of the inner cavity for the passage of the nail head, an elastic member transmitting elastic forces for the mutual approach and contact of the mobile members.

7. The device according to claim 6, wherein, when the mobile members are in the adjacent and mutual contact condition, a diameter of the transversal section, at least of the distal end portion of the muzzle cavity, is equal or slightly bigger in comparison with the nails stem diameter; the inner muzzle cavity proximal end portion having a truncated cone shape, and having a vertex directly connected to the distal end portion.

8. The device according to claim 7, wherein there are two mobile members, the two mobile members being symmetric and constrained to swivel about respective second rotation pins which are mutually parallel to each other and additionally perpendicular in respect to the longitudinal axis of the inner cavity of the muzzle.

9. The device according to claim 1, wherein the second magazine is connected to the first magazine or to the shooting device by a mobile and resilient connector which allows for translation or a rectilinear translation with elastic recovery of the shooting device towards the jaws.

10. The device according to claim 1, further comprising a stop aligned to and fixed to a rib of the sliding guide, located on an opposite side of the shooting device with respect to the jaws to which the stop is at least partially faced, said stop having an abutment face for a nailed fastener and having a median recess for receiving nails positioned below the muzzle of the shooting device.

11. The device according to claim 10, wherein the stop is provided with a transversal step located below a frangible bridge connecting the fasteners kept between by the jaws with an adjacent fastener for facilitating shearing of said frangible bridge.

12. The device according to claim 10, wherein the stop is connected to the second magazine or to the rib by a resilient element that is elastically deformable in the shooting direction of the shooting device.

13. The device according to claim 12, wherein the resilient element has an elongated plate shape and is "S" bended in a median portion thereof, ends of said resilient element being fixed to lower portions respectively of the stop and of the rib.

14. The device according to claim 12, wherein one of the stop and the rib is with a rib and the other of the stop and the rib is provided with a channel mutually engaged in a sliding manner that is perpendicular with respect to the resilient element.

15. The device according to claim 1, wherein the respective protrusions constitute a pair of legs of each fastener.

16. The device of claim 1, wherein the tongues are coplanar with the head and are provided at tongue ends thereof with tongue teeth protruding in a same direction as the legs for further fixing the respective fastener.

17. The device of claim 1, wherein the fasteners are united in an array or row of fasteners using frangible bridges connecting the tongues of adjacent fasteners.

18. The device of claim 17, wherein the tongues are coplanar with the head and are provided at tongue ends thereof with tongue teeth protruding in a same direction as the legs for further fixing the respective fastener.

19. The device according to claim 17, wherein the respective protrusions constitute a pair of legs of each fastener.

20. The device according to claim 19, wherein the slide guide comprises an elongated longitudinal median rib having a transversal section that is rectangular or frustoconical shaped, wherein the rib is longitudinally fixed into the second magazine, parallel to the forward sliding direction and is spaced from top and side inner walls of the second magazine to form a horizontal longitudinal cavity with a C-shaped cross section with two ends thereof facing down in order to slidably accommodate the set or row of fasteners with the respective heads oriented horizontally and placed above the legs of the protrusions, wherein inner faces of the fasteners match in a sliding manner with longitudinal side and top faces of the rib.

* * * * *